United States Patent [19]

Mason

[11] Patent Number: 5,052,455

[45] Date of Patent: Oct. 1, 1991

[54] BLOCK POSITIONER

[76] Inventor: Howard C. Mason, 31988 Country View La., Wilsonville, Oreg. 97070

[21] Appl. No.: 481,161

[22] Filed: Feb. 20, 1990

[51] Int. Cl.[5] ..... B27L 5/00

[52] U.S. Cl. ..... 144/209 A; 144/209 R; 82/118

[58] Field of Search ..... 144/208 R, 209 R, 209 A; 82/124, 117, 118 X

[56] References Cited

U.S. PATENT DOCUMENTS

| | | | |
|---|---|---|---|
| 3,252,488 | 5/1966 | Molyneux | 144/209 R |
| 4,239,071 | 12/1980 | Ritchie | 144/209 R |
| 4,398,580 | 8/1983 | Sohn et al. | 144/209 A |

*Primary Examiner*—Frederick R. Schmidt
*Assistant Examiner*—Lawrence Cruz
*Attorney, Agent, or Firm*—Kolisch, Hartwell, Dickinson, McCormack & Heuser

[57] ABSTRACT

Apparatus for positioning a block which may be used as a charger for a lathe. The apparatus includes opposed primary chucks, each taking the form of a tapered receptacle for receiving the end of a block. The primary chucks are each displaceable in x and y directions extending laterally of a rotation axis, to position a block in an optimum position for peeling veneer therefrom. A secondary chuck is associated with each primary chuck which extensible to grip a block independently of the primary chuck.

8 Claims, 4 Drawing Sheets

BLOCK POSITIONER

BACKGROUND AND SUMMARY OF THE INVENTION

This invention relates to apparatus for positioning a block with respect to an axis determined from data obtained by scanning of the block's periphery. More particularly, the invention concerns such a positioner used as a charger for a lathe, where the block takes the form of a log section and the log section is to be mounted in a lathe for rotation about an axis determined to produce maximum veneer production from the log section.

With the supply of timber becoming ever more restricted, and with logs when they are available usually being from second or third growth and of smaller size than the size of old growth logs, it is becoming increasingly important in the making of plywood that logs be cut in such a manner as to produce maximum veneer production. Furthermore, if plywood produced from the veneer is to be competitive with other building materials, the handling and cutting of the logs must be done in an efficient manner, and with automated or semi-automated equipment with minimal use of manpower.

In prior issued patent U.S. Pat. No. 4,802,946, there is disclosed a method of constructing laminated panels, i.e., plywood panels, which utilizes veneer pieces for all layers in the panel of a standard and uniform size. The procedure disclosed in this patent makes for economies through reducing trim loss associated with the production of a panel and reducing the handling of veneer pieces in their clipping, sorting, drying, storing, laying up, etc. The block positioner of the instant invention is well suited for the practicing of the method of this patent, as it makes possible the handling of log sections of relatively small diameters, as typifies second growth, with minimal manpower requirements and in an efficient manner.

Included among the general objects of this invention is the provision of a log positioner, including chuck means for gripping opposite ends of a log section or block, which is displaceable in x and y directions extending laterally of a rotation axis to change the rotation axis of the log held in the positioner.

Another general object is to provide a positioner which includes chuck means for holding the ends of a log section where the ends of a log section are held by means engaging its perimeter. Specifically, a chuck means may comprise a tapered hollow receptacle, which operates when a log end is inserted thereinto to funnel the end to a more-or-less centered position. Such a chuck means may readily handle log sections of varying diameters, with the mere act of gripping the ends of a log section serving roughly to center the log section through this funnelling action.

Another object is to provide, in a log positioner or like device, an orbital chuck, i.e., a chuck which may rotate about an axis which is offset from its center and a chuck wherein this offset is adjustable in x and y directions.

A further object is to provide a log positioner which includes chucks for gripping the ends of a log section or block, and which further includes scanning means for scanning the periphery of a block held, and means for producing adjustments in the chucks after scanning the log periphery with the log subsequently being rotatable to enable additional data to be obtained leading to a more finely tuned adjustment of the chucks.

Another object is to provide a block positioner with means for supplying blocks to the positioner which supports the blocks inwardly from their ends, chucks in the block positioner which engage or grip the ends of blocks by gripping their peripheries, and means for then holding the blocks and transferring them to a lathe which grips the blocks through engaging the ends of the blocks.

Yet another object is to provide in a positioner the combination of a primary and a secondary chuck, where the primary chuck engages the end of a block by engaging its perimeter at the end, the secondary chuck being extensible beyond the primary chuck to grip a log through its end to hold a block prior to its being transferred to a lathe.

These and other objects and advantages are attained by the invention, which is described hereinbelow in conjunction with the accompanying drawings, wherein.

The specific embodiment of the invention herein disclosed takes the form of what is referred to as block charger or positioner, which is supplied with blocks, i.e., log sections with a log section being scanned while rotated by the block charger to determine the location of a turn axis extending longitudinally of the log section which is calculated to produce maximum production of veneer with the log section rotated on this turn axis during the veneer cutting operation. With this turn axis determined, and with the log held between opposed transfer arms with the turn axis accurately positioned relative to these transfer arms, the log section may then be transferred to a lathe, to be held by the chucks in the lathe, with the turn axis coinciding with the rotation axis for the lathe chucks.

Figure 1:
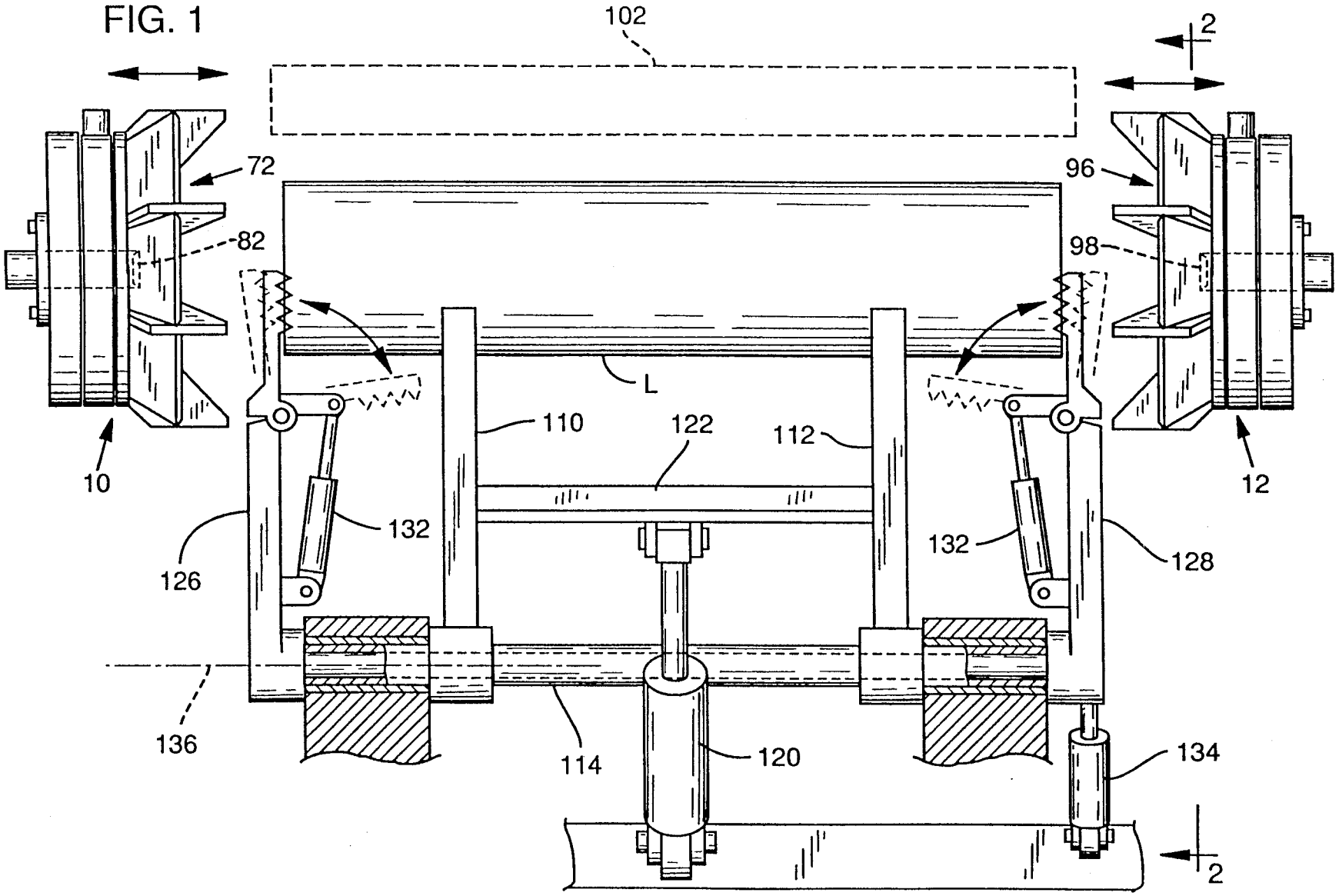
FIG. 1 is a side elevation, somewhat simplified, illustrating portions of a block positioner as contemplated herein, and supply means for supplying blocks, one after another, to the positioner.

Referring to FIG. 1, the apparatus includes what is referred to herein as a double chuck assembly 10 disposed adjacent one end of the block positioner and another double chuck assembly 12 spaced from and facing assembly 10. Chuck assemblies 10 and 12 are similar in construction, and for this reason, only one of the chuck assemblies will be described in detail.

Figure 3:
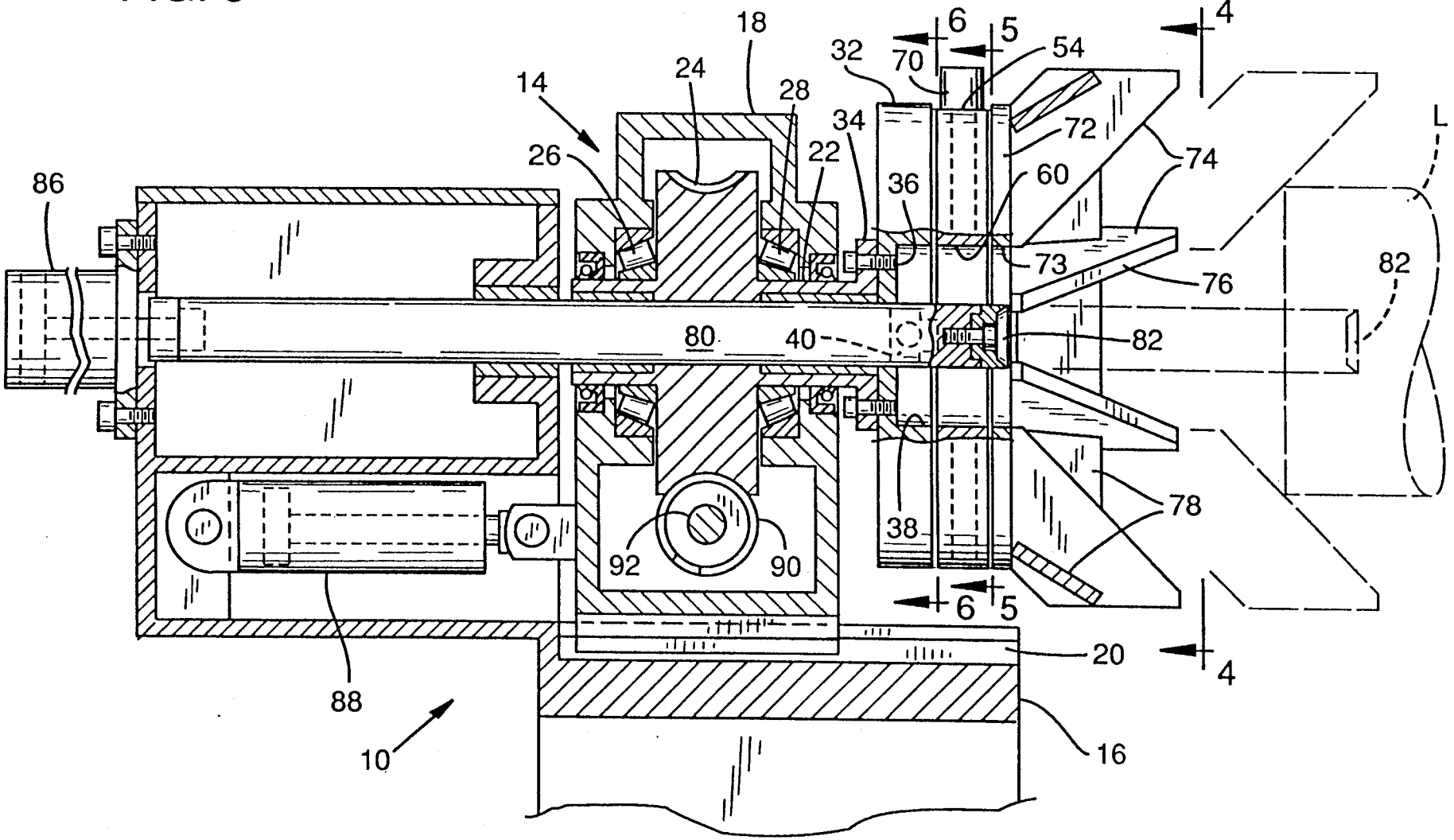
FIG. 3 is a view, on a somewhat enlarged scale, and partially in cross-section, showing details of a stand in the block positioner and the mounting on this stand of a centering chuck (also referred to as a primary chuck), and a relatively moveable inner or secondary chuck.
Figure 4:
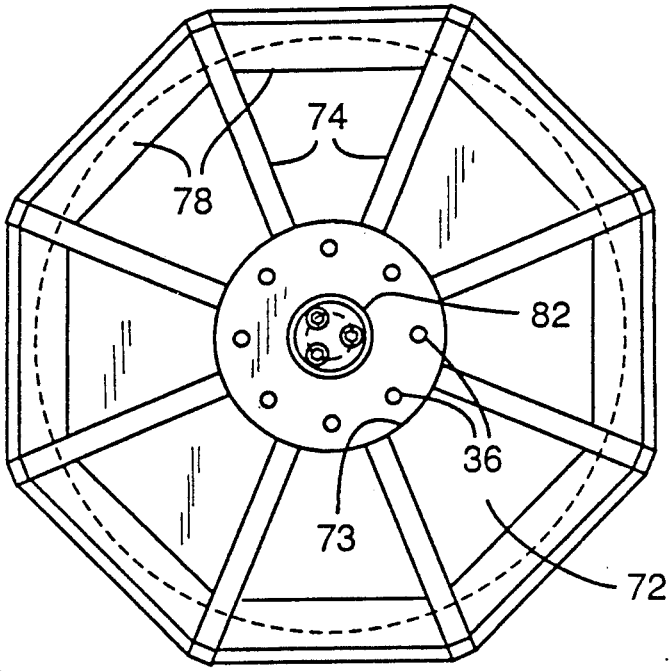
FIG. 4 is a view taken generally along the line 4—4 in FIG. 3.
Figure 5:
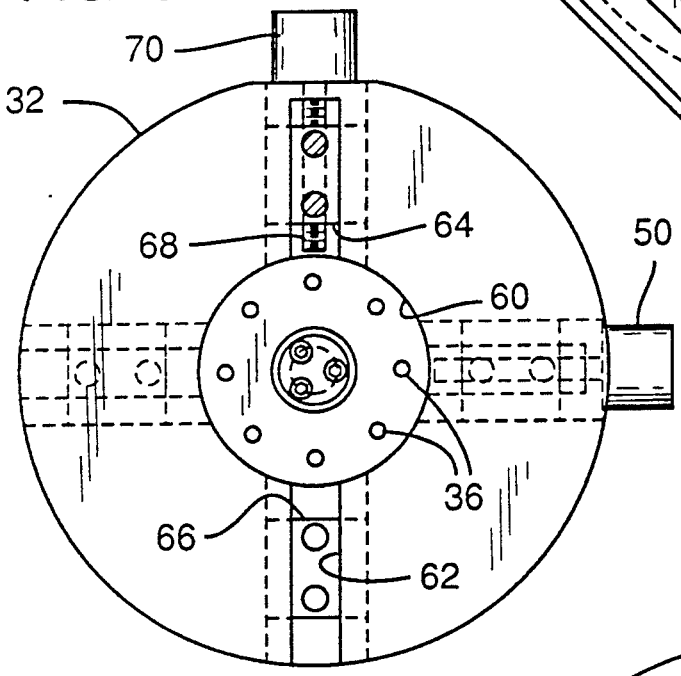
FIG. 5 is a view taken generally along the line 5—5 in FIG. 3.

Referring to FIG. 3, double chuck assembly 10 is supported in the block positioner by a support assembly 14 which is guidably mounted in the apparatus on a stand 16. Specifically, the support assembly includes a suitable casing 18 which is guidably supported at its base by a horizontal way 20 extending along stand 16. The stand may be anchored in place in any suitable manner.

Extending through the interior of casing 18 is a hollow spindle 22. Joined to this spindle intermediate its ends is a worm wheel 24. The spindle and worm wheel are suitably rotatably mounted within the casing as by bearing assemblies 26, 28.

Double chuck assembly 10 includes what is referred to herein as a rear mounting plate 32. A hub plate 34 suitably secured to the right end of spindle 22 as such appears in FIG. 3 is fastened, as by screws or fasteners 36, to rear mounting plate 32.

Figure 6:
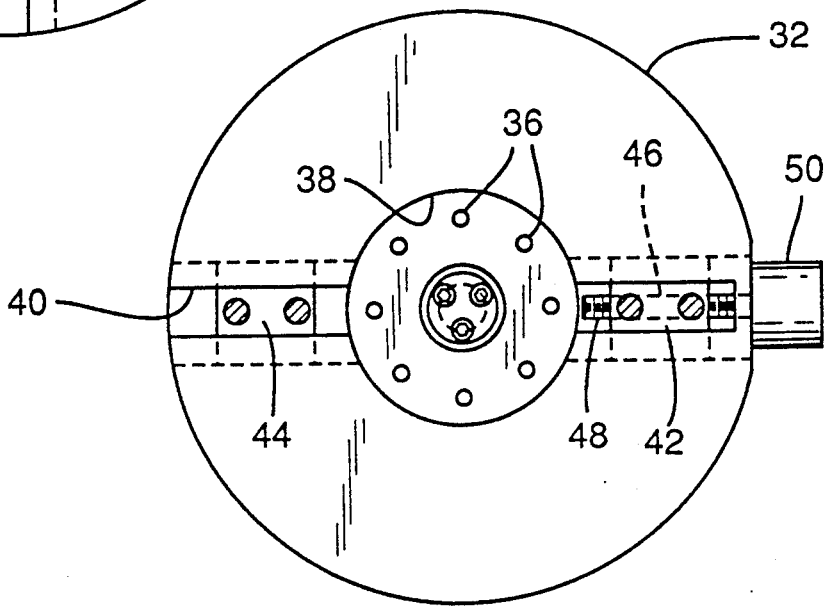
FIG. 6 is a view taken generally along the line 6—6 in FIG. 3.

The rear mounting plate may have a substantially circular outline when viewed from the front of the plate, as illustrated in FIG. 6. The plate has a central cavity 38, and extending across the face of the plate on either side of this cavity, an elongate channel 40. The channel has a "T"-shaped cross-section. Slidably mounted in the channel, on either side of cavity 38, are slide members 42, 44 with a matching "T" shaped cross-section.

One of the slide members, i.e., member 42, has a threaded passage 46 extending along its interior. A threaded shaft 48 received within this passage as an end rotated under power by a reversible motor generally shown at 50. Turning of the shaft in one direction causes slide member 42 (in effect, a nut) to travel toward the right as shown FIG. 6. Reverse rotation of the shaft causes the slide member to travel to the left.

The double chuck assembly further includes a front mounting plate 54. This plate, like plate 32, may also have a substantially cylindrical outline when viewed from the face.

Mounting plate 54 is joined through its back side with slide members 42, 44. Wear plates (not shown) may be provided interposed between mounting plate 32 and mounting plate 54. The construction described enables the front mounting plate to be shifted or displaced relative to the rear mounting plate in a direction extending laterally of the axis of hollow spindle 22, in what is referred to as an "x" direction.

The front mounting plate has a cylindrical opening 60 at its center. Extending across its front face and to either side of this opening is "T"-shaped channel 62. Riding within this channel are "T" slide member 64, 66 similar to members 42, 44 earlier are "T" slide member 64, 66 similar to members 42, 44 earlier discussed. One of these, for example, member 64, has a threaded bore extending therethrough and this receives threaded shaft 68 powered by motor 70.

Disposed forwardly of the front mounting plate is what is referred to as a centering chuck plate 72 with a center opening 73. The rear of this plate is joined to slide members 64, 66. Channel 62 extends at right angles to channel 40. Thus, with rotation of shaft 68, chuck plate 72 is moved or displaced laterally of the axis of spindle 22 in what is referred to herein as a "y" direction.

From this description it should be obvious that the center of centering chuck plate 72 is adjustably displaceable in all direction relative to the axis of spindle 22, which is the rotation axis of the chuck assembly.

Chuck plate 72 has a series of blade elements 74 joined thereto and projecting forwardly of the front face of the plate. These blade elements have inclined, inwardly sloping lead surfaces designated at 76. Interconnecting these blade elements, and making them rigid, are brace plates 78. Blade elements 74 and plate 72 constitute a centering chuck.

The blade elements impart to the centering chuck (or the outer chuck) what is, in effect, a tapered receptacle for receiving the end of a block or log section, where such block has a diameter which is less than the distance between the outer ends of blade elements 74 on diametrically opposite sides of the centering chuck. With the end of a log section placed into this receptacle, the end of the log section travels inwardly on the centering chuck, with a funnelling action taking place, which tends to produce rough centering of this log section on the centering chuck.

Extending through the interior of spindle 22, and suitably relatively rotatably supported therewithin, is an elongate shaft 80. The right end of the shaft, as such is illustrated in FIG. 3, terminates in an annular, sharpened flange 82, which constitutes an inner or secondary chuck in the double chuck assembly. In a relatively retracted position, this chuck has its gripping face, i.e., flange 82, positioned approximately at the location of centering chuck plate 72.

Opening 60 and opening 73 have substantial diameters in comparison with the diameter of shaft 80, accommodating displacement of the centering chuck whereby such can assume different orbital positions with respect to the rotation axis of spindle 22 (and the axis of shaft 80 which extends through the spindle).

The inner or secondary chuck is shifted axially through operation of a fluid-operated ram 86 which is connected to an end of shaft 80. A fluid-operated ram 88 interposed between the stand and casing 18 is actuated to shift the casing (and the worm wheel and spindle contained therewithin) to and fro in the direction of the axis of rotation of the chuck assembly.

Worm wheel 24 is engaged by a worm gear 90 and this worm gear, in turn, is rotated by a power-driven shaft 92. With rotation of the worm gear, the worm wheel and chuck assembly are rotated about the axis of spindle 22.

Double chuck assembly 12 which is spaced from and opposite assembly 10 is constructed in a similar fashion. Like assembly 10, double chuck assembly 12 includes (see FIG. 1) a centering chuck shown at 96 in FIG. 1, and an inner, secondary chuck indicated at 98. Both are shiftable in a horizontal path toward and away from double chuck assembly 10 which is opposite.

Illustrated at 102 is a curtain scanner. The scanner is conventional, and is capable, in effect, of electronically plotting the contour of a log section disposed below it and supported through its ends by chuck assemblies 10, 12.

Figure 7:
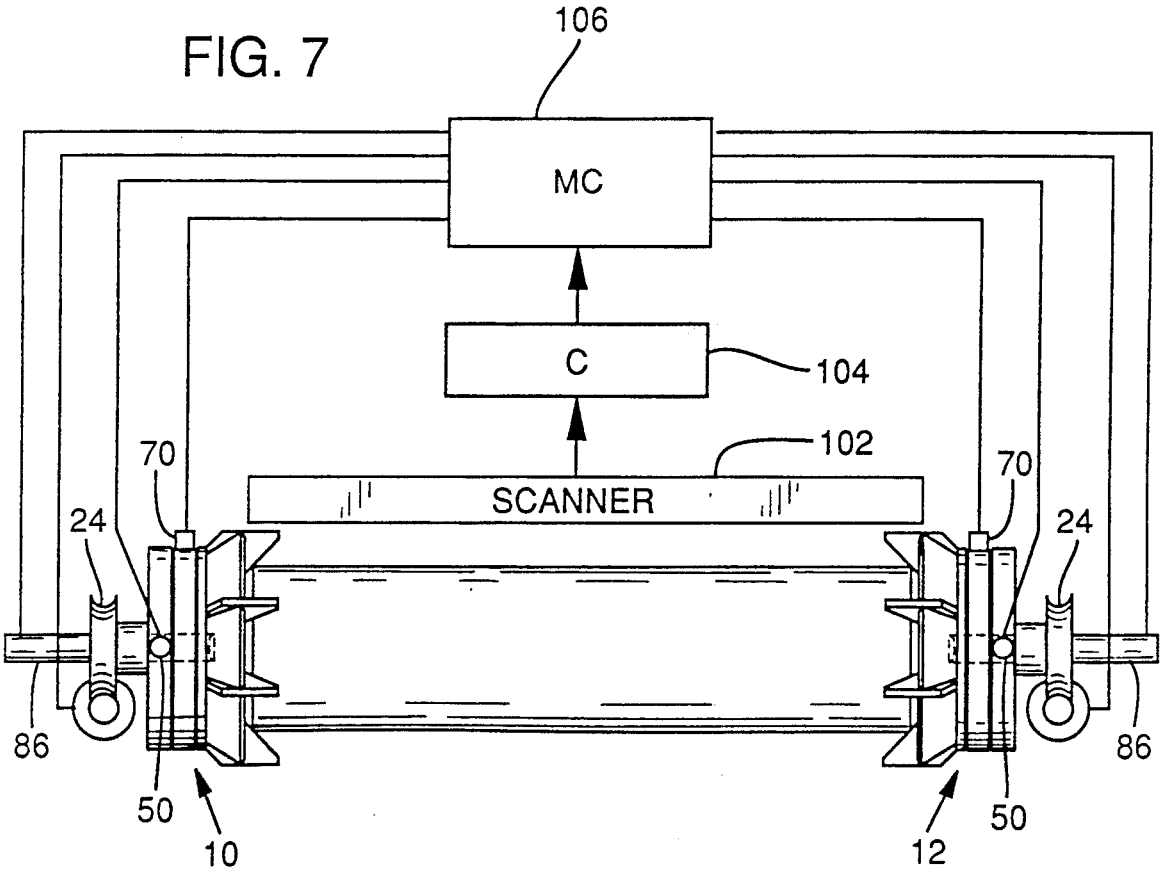
FIG. 7 is a schematic view of controls in the apparatus.

Referring to FIG. 7, data obtained from scanner 102 is supplied to a computer 104. The computer determines for a given log profile sensed by the scanner the axis about which the log section or block should be turned to produce optimum veneer production when the log is rotated in a lathe and veneer cut with a knife. Log sections are not true cylinders. Quite frequently, for instance, the log section will have slight taper or the log section may include a crook or other deviation which serves to set each log section apart from others.

Information from the computer is supplied to a motor control unit shown at 106. The motor control unit supplies signals controlling operation of motors 50, 70 producing adjusted displacement of the centering chuck in each chuck assembly with respect to the chuck's rotation axis.

With the apparatus of the invention, it is contemplated that a log section or a block will be placed in the double chuck assemblies to be held through its peripheries at opposite ends by the centering chuck which is part of each double chuck assembly. The log is then rotated while so supported, and scanned, using scanner 102. With information obtained from this scanning, adjustments are made which has the effect of displacing each end of the log section or block in whatever direction is required to enable optimum production of veneer from the block. The log section or block after such adjustments is still held by the double chuck assemblies. This enables the log section or block again to be rotated and scanned, with the subsequent making of fine further adjustments in the position of the ends of the block which would produce optimum veneer production. If deemed necessary, and to obtain the most accurate positioning, the log may even be scanned during a third rotation with the production of data producing the most accurate log positioning.

Figure 2:
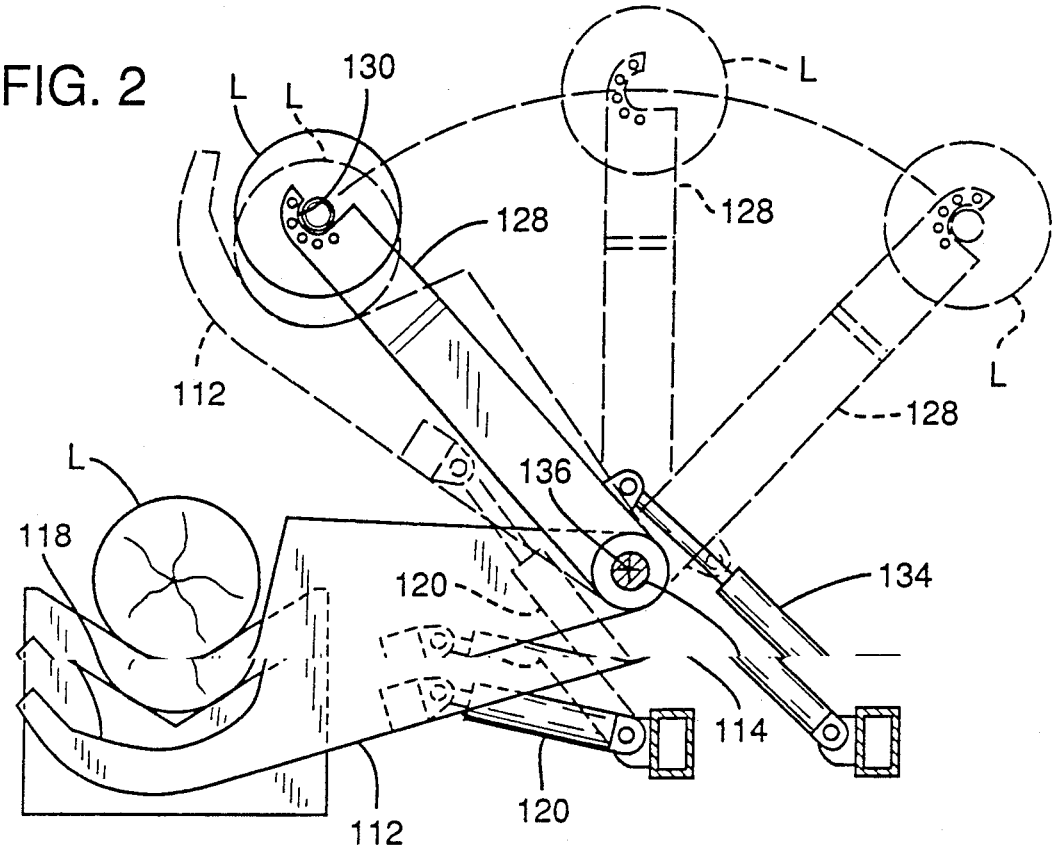
FIG. 2 is a simplified, elevational view, approximately on the line 2—2 in FIG. 1, illustratinq the operation of the supply means.

The apparatus contemplated further includes supply means for supplying a log section or block to a position located between the two chuck assemblies. As can be seen in FIGS. 1 and 2, such comprises a pair of block lifting arms 110, 112 secured to and extending outwardly from a journalled shaft 114. The lifting arms include cradles 118 at their outer ends. These enable the lifting arms to support a log section such as log section "L" in regions disposed inwardly from its opposite ends.

The lifting arms are swung from a lowered to a raised position through actuation of a ram 120. The ram has an extensible end pivotally connected to a brace 122 interconnecting the lifting arms. A log section cradled by the lifting arms and on being lifted by the arms is positioned with its ends between the double chuck assemblies (with the double chuck assemblies previously retracted to permit entry between them of the log section).

With the log section so positioned, the double chuck assemblies may be extended to cause the ends of the log section to be held by the double chuck assemblies through engagement of the centering chuck in each assembly with the periphery of the log section.

With a log section scanned and positioned following the method previously described, the log section is ready to be transferred to a lathe.

To transfer a log section, the inner secondary chuck of each chuck assembly is extended through actuation of ram 86. With the ends of the log section or block held by the secondary chucks, the primary or centering chucks may then be retracted with each centering chuck then moving free of the end of the log section.

It will be noted and referring to FIGS. 1 and 2 that the equipment includes a pair of transfer arms and such are indicated at 126, 128. The transfer arms have ends which are arcuately shaped at 130 whereby they may fit about a secondary chuck with the chuck biting into the end of the log section.

Teeth are provided on the arcuate ends of the transfer arms whereby with the transfer arms moved relatively toward each other the arcuate ends may firmly bite into the end of the log through engagement with its end. Movement of the transfer arms toward and away from each other is accomplished by extension and contraction of a ram 132. The transfer arms are swung about a horizontal axis to shift a log section held by the arms out of the block positioner and into a lathe through actuation of ram 134.

With the apparatus described, a block or log section is supplied to the positioner through cradling the log section in the cradles of block lifting arms 110, 112. With the log section so cradled and with the double chuck assemblies relatively retracted from each other the lifting arms are swung to place the ends of the cradled log section between the double chuck assemblies.

The centering chuck of each double chuck assembly is then extended by shifting it toward the opposite centering chuck. With a centering chuck moved over the end of a log section the log end is funnelled by the inclined surfaces of the blade elements in a centering chuck to a position wherein the center of the log roughly coincides with the rotation axis of the centering chuck. This initial positioning preferably is performed with the center of the centering chuck coinciding with the rotation axis of the chuck, which is the axis of hollow spindle 22.

The block is then rotated about an axis extending between the ends of the block. During rotation, scanning is performed of the perimeter of the block to obtain data relative to the block's perimeter. This data is supplied to the computer. The motor control unit responds to the computer and provides control signals to the motors 50, 70 producing displacement in x and y directions of the centering chucks.

In this way another rotation axis is established for the block held by the centering chucks. The block may again be rotated and scanned. According to information obtained from the scanning, fine adjustments may be made in the positions of the centering chucks to produce extremely accurate positioning of the block so that the calculated turn axis which produces maximum veneer production coincides with the rotation axis of the centering chucks in the two chuck assemblies.

With this established, the block is readily transferred to place its ends between the chucks of a lathe. This transfer is performed by first extending the secondary chucks whereby the log ends are gripped inwardly from their perimeters and by retracting the centering chucks which frees them from the ends of the log section. The transfer arms are then actuated to grip the log section through its ends with the secondary chucks then being retractable to free the log for movement into the lathe.

While a particular embodiment of the invention has been described, it should be obvious that variations are possible, both in the construction as well as the organization of the positioner and its relation to the lathe or other instrumentality with which the positioner is incorporated. Included within the invention, therefore, are all modifications and variations coming within the scope of claims appended hereto.

It is claimed and desired to secure by Letters Patent:

1. Apparatus for positioning a block for rotation about an axis dictated by data obtained through scanning of the block comprising:

first and second rotatable chuck means mounted for relative movement toward and away from each other for rotatably supporting opposite ends of a block with the block rotatable about an axis extending between said chuck means, a secondary chuck associated with at least said first chuck means and said secondary chuck being rotatable about said axis and also shiftable along said axis relative to said first chuck means, power-operated means for relatively displacing independently of said secondary chuck said first and second chuck means in a direction extending laterally of said axis thus to shift the ends of the block with respect to said axis, scanning means for scanning the periphery of the block with the block in different positions as rotatably supported by said chuck means and producing control data from the scanning, and control means responding to the control data of the scanning means controlling said power-operated means.

2. The apparatus of claim 1, wherein at least said first chuck means includes a tapered receptacle with a larger diameter end facing the second chuck means and an opposite smaller diameter end and the receptacle having a diameter that gradually decreases progressing from the larger to the smaller diameter end for receiving the end of a block and the receptacle gripping the end of a block through engagement with the perimeter of the block.

3. The apparatus of claim 1, which further includes a supply means for supplying a block to a position located between said first and second chuck means, said supply means having means for movably supporting a block with the block supported inwardly from its ends and with the ends of the block free.

4. Apparatus for positioning a block comprising:

a pair of opposed rotatable chucks, each chuck having a tapered receptacle with a larger diameter end facing the other chuck and an opposite smaller diameter end and the receptacle having a diameter that gradually decreases progressing from the larger to the smaller diameter end, the receptacle grippingly engaging the end of a block through engagement with the perimeter of the block, and mounting means mounting the chucks whereby they are relatively moveable toward and away from each other, the chucks being rotatable about an axis extending from one to the other chuck and said mounting means including displaceable means associated with at least one chuck for displacing the chuck in x and y directions extending laterally of said axis.

5. The apparatus of claim 4, which further comprises power-operated means associated with said displaceable means for producing displacement of the chuck under power.

6. The apparatus of claim 5, and further comprising a secondary chuck associated with said one chuck mounted for movement along said axis relative to the said one of said opposed chucks and toward and away from the other of said opposed chucks, said secondary chuck gripping a block in a region disposed inwardly from the perimeter of the block, and wherein said displaceable means associated with said one chuck produces displacement of the one chuck independently of any displacement of said secondary chuck.

7. A method of positioning a block comprising:

establishing a rotation axis for the block with the axis extending between the ends of the block, rotating the block about this axis, during the rotation scanning the perimeter of the block to obtain data related to its perimeter, reestablishing the rotation axis for the block according to data obtained from the scanning and again rotating the block and scanning the perimeter of the block to obtain additional data related to the perimeter of the block as rotated.

8. An apparatus for positioning a block, the improvement comprising:

a support assembly, a primary chuck rotatably mounted on the support assembly for rotation about a substantially horizontal axis and facing outwardly from the support assembly, the primary chuck including a tapered receptacle having a larger diameter end facing outwardly from the chuck and an opposite smaller diameter end and the diameter of the receptacle gradually decreasing progressing from the larger to the smaller diameter end, the receptacle being adapted to grip a block by engaging the perimeter of the block, a secondary chuck mounted on the support assembly facing outwardly in the same direction from the support assembly as the primary chuck and having an axis which coincide with the rotation axis of the primary chuck, means for shifting the secondary chuck along its axis and relative to the primary chuck between a position where the secondary chuck is behind the primary chuck and a position where the primary chuck is disposed forwardly of the primary chuck, the mounting for the primary chuck including means whereby the primary chuck is adjustably positionable relative to its rotation axis in x and y directions extending laterally of this rotation axis and independently of any lateral movement in the secondary chuck.

* * * * *